US005798734A

United States Patent [19]

Ohtsuka et al.

[11] Patent Number: 5,798,734

[45] Date of Patent: Aug. 25, 1998

[54] ANTENNA APPARATUS, METHOD OF MANUFACTURING SAME AND METHOD OF DESIGNING SAME

[75] Inventors: Masataka Ohtsuka; Yoji Isota; Makoto Matsunaga; Yoshihiko Konishi; Shintaro Nakahara, all of Tokyo, Japan

[73] Assignee: Mitsubishi Denki Kabushiki Kaisha, Tokyo, Japan

[21] Appl. No.: 708,225

[22] Filed: Sep. 6, 1996

[30] Foreign Application Priority Data

Oct. 6, 1995 [JP] Japan ..... 7-260474

[51] Int. Cl.[6] ..... H01Q 1/38

[52] U.S. Cl. ..... 343/700 MS; 343/846

[58] Field of Search ..... 343/700 MS, 702, 343/846, 848, 872

[56] References Cited

U.S. PATENT DOCUMENTS

| | | | |
|---|---|---|---|
| 4,827,271 | 5/1989 | Berneking | 343/700 MS |
| 5,166,693 | 11/1992 | Nishikawa et al. | 343/700 MS |
| 5,243,353 | 9/1993 | Nakahara et al. | 343/700 MS |
| 5,382,959 | 1/1995 | Pett et al. | 343/700 MS |
| 5,481,272 | 1/1996 | Yarsunas | 343/872 |
| 5,619,217 | 4/1997 | Mailandt et al. | 343/872 |

FOREIGN PATENT DOCUMENTS

| | | | |
|---|---|---|---|
| 0031204 | 2/1982 | Japan | 343/700 MS |
| 0207703 | 11/1984 | Japan | 343/700 MS |
| 0221007 | 12/1984 | Japan | 343/700 MS |
| 2252304 | 10/1990 | Japan . | |
| 4154306 | 5/1992 | Japan . | |

*Primary Examiner*—Donald T. Hajec
*Assistant Examiner*—Tan Ho
*Attorney, Agent, or Firm*—Rothwell, Figg, Ernst & Kurz

[57] ABSTRACT

An antenna apparatus, a method of manufacturing the same, and a method of designing the same, are provided. A first dielectric layer, first dielectric film, second dielectric layer and second dielectric film are laminated on a flat metal plate in the mentioned order. A radiation element fed through a feeding line is arranged below another radiation element that is not fed through the feeding line. The feeding line forms, along its overall length, a microstrip line having the dielectric layer sandwiched by the feeding line and the flat conductive plate, resulting in no model change from the microstrip line to a triplate line or vice versa, with reduced feeding loss. The thickness of the dielectric layer is so set as to be sufficiently small compared with the used wavelength, to thereby suppress the radiation from discontinuities lying on the microstrip line constituted of the feeding line and flat conductive plate. This eliminates the need for a metal shield plate to prevent unnecessary radiation from the feeding line.

15 Claims, 14 Drawing Sheets

PRIOR ART

ANTENNA APPARATUS, METHOD OF MANUFACTURING SAME AND METHOD OF DESIGNING SAME

BACKGROUND OF THE INVENTION a) Field of the Invention

The present invention relates to an antenna apparatus, for example, an antenna apparatus capable of being used in earth receiving stations for satellite communication, satellite broadcasting, etc., and further to a method of manufacturing the same and a method of designing the same.

b) Description of the Prior Art

Japanese Patent Laid-open Pub. No. Hei 2-252304 discloses a configuration as shown in FIGS. 23 and 24 in which dielectric layers 12 and 14, a film 16, a dielectric layer 18 and a metal shield plate 20 are sequentially laminated on top of a flat conductive plate 10. The dielectric layers 14, 18 and metal shield plate 20 are respectively provided with apertures 22, 24 and 26. Arranged within the aperture 22 is a radiation element 28 formed on the dielectric layer 12 and fed through a feeding line 32 whilst arranged within the aperture 24 is a radiation element 30 formed on the film 16 and electromagnetically coupled with the radiation element 28. The radiation element 30 aids in realizing impedance matching over a relatively wide frequency band.

In the above configuration a triplate line is apparently formed by the flat conductive plate 10, feeding line 32 and metal shield plate 20. At a region designated at reference numeral 34 in FIG. 23, in particular, where the triplate line is connected to a microstrip line, discontinuities may occur in transmission mode associated with feeding. As a result of this, upon feeding to the radiation element 28, signal transmission in parallel plate mode, and therefore feeding loss, will be increased. In addition, the radiation element 30 and the metal shield plate 20 are provided on separate layers, which will require additional constituent parts and hence raise its price. It is envisaged that the above problems can be solved by obviating the metal shield plate 20. Mere removal of the metal shield plate 20 will inconveniently allow unnecessary signals to be radiated from the feeding line 32.

SUMMARY OF THE INVENTION

It is therefore a first object of the present invention to realize an antenna apparatus having a reduced feeding loss and to realize an antenna apparatus including a reduced number of constituent parts and being capable of being manufactured at lower costs. This object is achieved by obviating a metal shield plate. A second object of the present invention is to realize an antenna apparatus free of unnecessary radiation from a feeding line despite the removal of the metal shield plate. This object is achieved by appropriately setting the thickness of dielectric layers. A third object of the present invention is to realize an antenna apparatus ensuring a proper operation over a relatively wide frequency band. This object is accomplished by improving a conductive layer or by providing an additional dielectric layer. A fourth object of the present invention is to improve the strength bearing ability of a layered structure and the working accuracy of its manufacturing process, thereby making it possible to manufacture an apparatus having stabler characteristics. This object is accomplished by improving a radome.

According to first aspect of the present invention there is provided an antenna apparatus comprising a conductive layer having front and back surfaces; a first dielectric layer having front and back surfaces and being arranged so that the rear surface thereof confronts the front surface of the conductive layer, the first dielectric layer having a thickness less than the wavelength of a signal to be radiated; second dielectric layer having front and back surfaces and being arranged so that the rear surface thereof confronts the front surface of the first dielectric layer; first and second radiation elements disposed on top of the front surface of the first and second dielectric layers, respectively, in such a manner that respective centers of the first and second radiation elements vertically coincide with each other by way of the second dielectric layer; and a feeding line disposed on top of the front surface of the first dielectric layer for use in feeding associated with the first radiation element.

In this aspect, the thickness of the first dielectric layer is less than the wavelength of signals to be radiated. Therefore even though transmission mode discontinuities have occurred in the feeding line at a region such as a corner structure or transformer structure, the feeding line will merely give rise to radiation and feeding loss to such a low degree that may be neglected. This results in reduced feeding loss and no need for the metal shield plate intended to prevent unnecessary radiation from the feeding line. In other words, this aspect will provide the antenna apparatus ensuring a lower level of feeding loss and having a reduced number of constituent parts and reduced manufacturing costs compared with the conventional ones.

A second aspect of the present invention is an antenna apparatus in which the conductive layer in the first aspect includes a recess positioned and formed in the front surface thereof in such a manner that the recess is superposed over the first radiation element by way of the first dielectric layer when viewed from below in a vertical direction. A third aspect of the present invention is an antenna apparatus in which the recess in the second aspect is larger than the first radiation element, the recess being positioned and formed in such a manner that the entirety of the first radiation element is included within the recess when viewed from above in a vertical direction. A fourth aspect of the present invention is an antenna apparatus further comprising a dielectric piece disposed within the interior of the recess in the second or third aspect. A fifth aspect of the present invention is an antenna apparatus in which the dielectric piece in the fourth aspect is formed of a foamed dielectric.

The recess formed in the second aspect serves to enlarge the distance between the first radiation element and the front surface of the conductive layer. Accordingly, as the distance between the first radiation element and the front surface of the conductive layer increases, the width of a frequency band whose voltage standing wave ratio (hereinafter referred to as VSWR) or reflection loss is small, generally increases. The formation of the above-described recess will therefore enlarge the width of the frequency band allowing impedance matching. At that time there is no necessity to increase the thickness of the first dielectric layer, and hence the effect obtained in the first aspect will also be obtained. Furthermore the electrical lines of force emitted from the edge portions of the first radiation element are generally allowed to disperse over a wider range than the dimensions of the first radiation element. The adoption of the third aspect will also enable the electrical lines of force from the edge portions of the first radiation element to fall into the interior of the recess, thus further enhancing the effect of the second aspect. The dielectric piece introduced into the interior of the recess in the fourth aspect contributes to reinforce the structure in the region of the recess. If its material is a foamed dielectric as in the fifth aspect, the introduction of the dielectric piece will lead to a lower possibility of increased loss.

A sixth aspect of the present invention is an antenna apparatus further comprising a third dielectric layer disposed on top of the front surface of the second dielectric layer in the first to fifth aspects. A seventh aspect of the present invention is an antenna apparatus in which the third dielectric layer in the sixth aspect has a dielectric constant higher than that of the first and second dielectric layers. An eighth aspect of the present invention is an antenna apparatus in which the third dielectric layer in the sixth or seventh aspect is used as a radome for environmentally protecting at least the first and second radiation elements. A ninth aspect of the present invention is an antenna apparatus further comprising a fixing member for firmly securing the third dielectric layer in the sixth to eighth aspects to the conductive layer. A tenth aspect of the present invention is an antenna apparatus further comprising a columnar member formed integrally with the third dielectric layer in the ninth aspect and extending through the first and second dielectric layers into the conductive layer, the extremity of the columnar member being firmly secured to the conductive layer by means of the fixing member.

The third dielectric layer formed in the sixth aspect has a function of inducting the electric lines of force emitted from the first radiation element toward the second radiation element. This induction will strengthen an electromagnetic coupling between the first radiation element and the second radiation element. The thus strengthened electromagnetic coupling between the first and second radiation elements will enlarge the width of the frequency band having a smaller VSWR or reflection loss. The formation of the third dielectric layer described above will therefore lead to an increase of the frequency band width allowing impedance matching. At that time there is no need to increase the thickness of the first dielectric layer, and hence the effect obtained in the first aspect is also obtained. In addition because there is no need to form such a recess as in the second aspect, it will enable the conductive layer to be thinner than that of the second aspect, resulting in a compact apparatus. Furthermore if the dielectric constant of the third dielectric layer is set at a higher value as in the seventh aspect, the effect of strengthening the electromagnetic coupling obtained in the sixth aspect will be further enhanced, allowing the impedances to be matched over an even wider frequency band. In the eighth aspect, the third dielectric layer may also be used as a radome to reduce the size of the apparatus. Moreover in the ninth aspect, there may be provided a fixing member by means of which the third dielectric layer is firmly secured to the conductive layer so as to ensure a steadily powerful and integral retention of the individual dielectric layers and the conductive layer. In the tenth aspect, there may also be provided a columnar member extending through the first and second dielectric layers, with the extremity of the columnar member being fastened to the conductive layer by the fixing member. This will allow the individual dielectric layers and conductive layer to be powerfully and integrally retained even in the vicinity of the center of the apparatus. The thus increased retention strength will lead to an improvement in the working accuracy in the manufacturing process and to the manufacture of apparatuses having steadier characteristics.

An eleventh aspect of the present invention is an antenna apparatus in which the first dielectric layer in the first to tenth aspects has a thickness equal to or less than 1% of a wavelength to be radiated. A twelfth aspect of the present invention is an antenna apparatus in which the first dielectric layer in the first to eleventh aspects has an overlaid structure consisting of a first dielectric film and a first dielectric substrate, the first dielectric film having a surface on which the first radiation element and the feeding line are formed, the first dielectric substrate having a thickness sufficient to maintain the distance between the conductive layer and the first radiation element. A thirteenth aspect of the present invention is an antenna apparatus in which the second dielectric layer in the first to twelfth aspect has an overlaid structure consisting of a second dielectric film and a second dielectric substrate, the second dielectric film having a surface on which the second radiation element is formed, the second dielectric substrate having a thickness sufficient to maintain the distance between the first radiation element and the second radiation element. A fourteenth aspect of the present invention is an antenna apparatus in which the first or second dielectric substrate in the twelfth or thirteenth aspect comprises a substrate formed of a foamed dielectric.

In the case where the first to tenth aspects are be used to realize the antenna apparatus suitable for the transmission or reception of microwaves having a relatively long wavelength, it would be practical to set the thickness in accordance with the eleventh aspect. In the case of adopting a configuration in which, on one hand, the radiation elements are formed on the films, while on the other hand, the distances of the elements in the thickness direction are held by the dielectric substrates, as the twelfth or thirteenth aspect, the design of geometries and dimensions of the elements can be performed separately from the design of intervals of the individual elements in the thickness direction and the dielectric constant, contributing to an improvement in apparatus design freedom. Use of the foamed dielectric in the fourteenth aspect would realize a reduction in the feeding loss as well as an improvement in the radiation efficiency since the foamed dielectric generally has a low dielectric constant and low dielectric tangent.

According to a fifteenth aspect of the present invention there is provided a method of manufacturing an antenna apparatus provided with first radiation elements to be power fed and second radiation elements that are not to be power fed, the method comprising the steps of preparing a conductive plate, a first dielectric substrate having a uniform thickness less than a wavelength to be radiated, a first dielectric film having a thickness less than that of the first dielectric substrate, a second dielectric substrate having a uniform thickness, and a second dielectric film having a thickness less than that of the second dielectric substrate; forming, on the surface of the first dielectric film, a first radiation element and a feeding line for feeding the first radiation element; forming second radiation element on the surface of the second dielectric film; and after the execution of these steps, laminating, on the conductive plate, in the mentioned order, the first dielectric plate, the first dielectric film, the second dielectric substrate, and the second dielectric film in such a manner that the distance between the conductive plate and the first radiation element is maintained by the first dielectric substrate and the distance between the first radiation element and the second radiation element is maintained by the second dielectric substrate, and that respective centers of the first and second radiation elements vertically coincide with each other by way of the second dielectric substrate. In this aspect the antenna apparatus according to the first aspect is conveniently manufactured.

According to sixteenth aspect of the present invention there is provided a method of designing the antenna apparatus in accordance with the first aspect, the method comprising the steps of determining the dimensions and intervals of the first and second radiation elements so that frequency characteristics such as voltage standing wave ratio or reflection loss in a frequency band to be radiated describe a loop on a Smith chart and that this loop surrounds the center of the Smith chart; and determining the thickness of the first or second dielectric layer so as to ensure that the voltage standing wave ratio or the reflection loss in the frequency band to be radiated lies on the loop. In this case the frequency band allowing impedance matching (namely the frequency band having a smaller VSWR or reflection loss), and its width, will generally vary depending on the distance between the conductive layer and the first radiation element and on the distance between the first radiation element and the second radiation element. This aspect therefore ensures desirable design of the antenna apparatus in accordance with the first aspect.

According to a seventeenth aspect of the present invention there is provided a method of designing the antenna apparatus in accordance with the second aspect, the method comprising the steps of determining the dimensions and intervals of the first and second radiation elements so that frequency characteristics such as voltage standing wave ratio or reflection loss in a frequency band to be radiated describe a loop on a Smith chart and that this loop surrounds the center of the Smith chart; and determining the thickness of the first dielectric layer and dimensions of the recess so as to ensure that the voltage standing wave ratio or the reflection loss in the frequency band to be radiated lies on the loop. In this case the frequency band allowing impedance matching, and its width, will vary depending on the distance between the conductive layer and the first radiation element. The distance between the conductive layer and the first radiation element depends on the dimensions (e.g., depth) of the recess. This aspect therefore ensures desirable design of the antenna apparatus in accordance with the second aspect.

According to an eighteenth aspect of the present invention there is provided a method of designing the antenna apparatus in accordance with the sixth aspect, the method comprising the steps of determining the dimensions and intervals of the first and second radiation elements so that frequency characteristics such as voltage standing wave ratio or reflection loss in a frequency band to be radiated describe a loop on a Smith chart and that this loop surrounds the center of the Smith chart; and determining the dielectric constant of the third dielectric layer so as to ensure that the voltage standing wave ratio or the reflection loss in the frequency band to be radiated lies on the loop. In this case the frequency band allowing impedance matching, and its width, will vary depending on the strength of the electromagnetic coupling exerted between the first radiation element and the second radiation element. The strength of the electromagnetic coupling between the first and second radiation elements depends on the dielectric constant of the third dielectric layer. This aspect therefore ensures desirable design of the antenna apparatus in accordance with the sixth aspect.

DETAILED DESCRIPTION OF THE PREFERRED EMBODIMENTS

Figure 1:
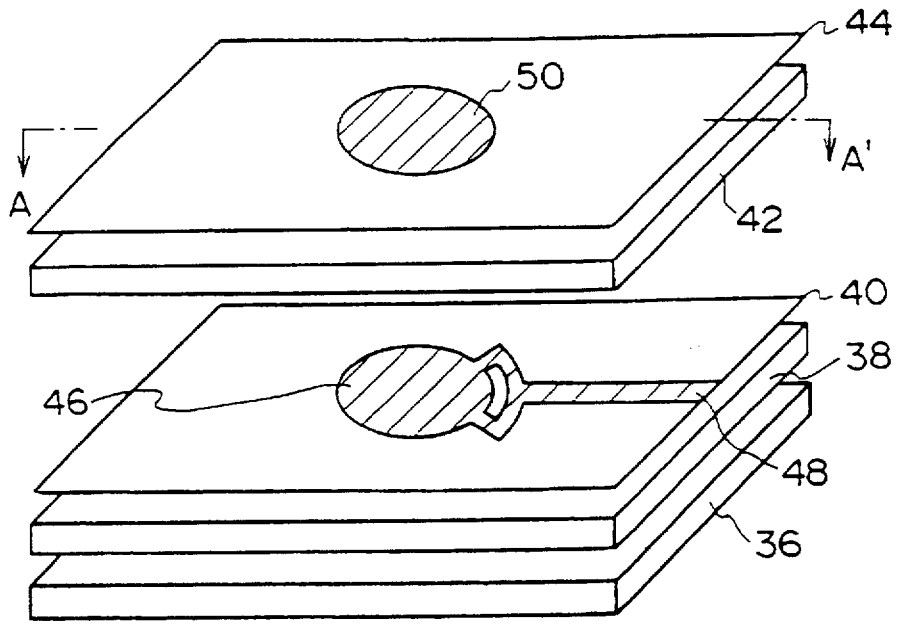
FIG. 1 is an exploded perspective view showing a configuration of an antenna apparatus according to first embodiment of the present invention.

The present invention will now be described by way of non-limitative embodiments thereof with reference to the accompanying drawings. It is to be noted that members common to various embodiments are designated by the same reference numerals and will not be repeatedly explained.

a) Embodiment 1

Figure 2:
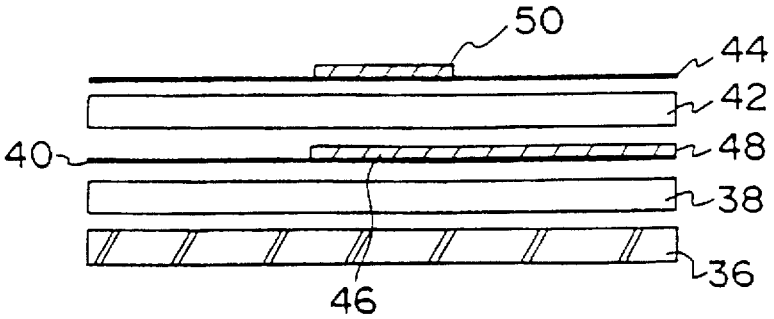
FIG. 2 is an end view, taken along the line A–A' of FIG. 1, of the antenna apparatus according to the first embodiment of the present invention.

Referring first to FIGS. 1 and 2 there is depicted a configuration of an antenna apparatus in accordance with first embodiment of the present invention. As shown in the diagrams the antenna apparatus of this embodiment comprises a flat conductive plate 36 on which a dielectric layer 38, a dielectric film 40, a dielectric layer 42, and a dielectric film 44 are laminated in the mentioned order. A radiation element 46 and a feeding line 48 for feeding the radiation element 46 are formed on top of the upper surface of the dielectric film 40. Another radiation element 50 is formed on top of the upper surface of the dielectric film 44. The radiation elements 46, 50 and the feeding line 48 are made of, for instance, a copper foil and are formed on the dielectric film 40 or 44 by etching or some other method. The dielectric layers 38 and 42 are provided in the form of foamed dielectrics 38 and 42 generally having a low dielectric constant and a low dielectric tangent. Use of such foamed dielectrics will ensure not only a reduction in the feeding loss which may occur when feeding to the radiation element 46 but also an increase in the radiant intensity of the radiation elements 46 and 50. The dielectric layers 38 and 42 also serve as spacers which space at proper intervals, respectively, the flat conductive plate 36 and the radiation element 46, and the radiation element 46 and the radiation element 50. It is to be appreciated that although not shown, the flat conductive plate 36, dielectric layer 38, dielectric film 40, dielectric layer 42, and dielectric film 44 are tightly fastened together by means of fixing members such as screws, or are adhesively joined together by adhesive or the like.

In the case of radio transmitting a signal by use of the antenna apparatus according to this embodiment, a radio frequency signal is fed through the feeding line 48 to the radiation element 46. When excited by the radio frequency signal, the radiation element 46 radiates the radio frequency signal as an electromagnetic radio wave in a predetermined direction. The radiation element 50 on the other hand is electromagnetically coupled with the radiation element 46. It is therefore possible to match the input impedance over a relatively wide frequency band compared with the case without the radiation element 50, by appropriately designing the parts constituting the apparatus, as will be described later. Radiation from the radiation element 46, together with radiation from the radiation element 50 excited by way of the above-described electromagnetic coupling, is emitted in the form of an electromagnetic wave. The description of the action at the time of receiving will be omitted here because it is obvious from the description of the action when transmitting.

A major characteristic of this embodiment lies in the obviating of a metal shield plate to prevent unnecessary radiation from the feeding line 48. In this embodiment the abolition of the metal shield plate will lead to no existence of a region in which the feeding line 48 constitutes a triplate line. More specifically the feeding line 48, along its overall length, constitutes a microstrip line in which the dielectric layer 38 is sandwiched between the feeding line 48 and the flat conductive plate 36, resulting in no change in transmission mode from the triplate line to the microstrip line, and vice versa. This will prevent any loss arising from an unnecessary mode. Such ability to obviate the metal shield plate is owed chiefly to an extremely small thickness of the dielectric layer 38 compared with the wavelength associated with the radiation. In other words, due to an extremely small distance between the flat conductive plate 36 and the feeding line 48, very little radiation will be allowed from discontinuities on the microstrip line comprised of these electrodes, for instance, from corners or transformer portions, resulting in a negligible radiation loss.

This embodiment thus makes it possible to obtain an antenna apparatus having a lower feeding loss compared with conventional ones. Furthermore the fact that there is no need for the metal shield plate will contribute to a reduction in the number of constituent parts and hence the realization of reduced price.

It is also envisaged that accordingly, as the dielectric layer 38 becomes thinner, the radiation loss decreases but the conductor loss increases, whereas accordingly, as the dielectric layer 38 becomes thicker the radiation loss increases but the conductor loss decreases. The radiation and conductor losses will both give rise to a reduction in efficiency of the antenna. It is therefore preferable to set the thickness of the dielectric layer 38 so as to minimize the total of the radiation loss and the conductor loss. That is, the thickness of the dielectric layer 38 is to be sufficiently small relative to the wavelength of the electronic radio wave associated with the radiation, for instance, it can be in the order of 1% or less of that wavelength. In the case where the antenna apparatus according to this embodiment is applied to satellite communication using microwaves and the used electromagnetic waves lie in relatively low frequency bands such as L band or S band, taking into consideration the fact that the wavelength associated with these bands is approximately 100 to 300 mm, it is envisaged that such setting of the thickness at 1% or less would be significantly practical.

Figure 3:
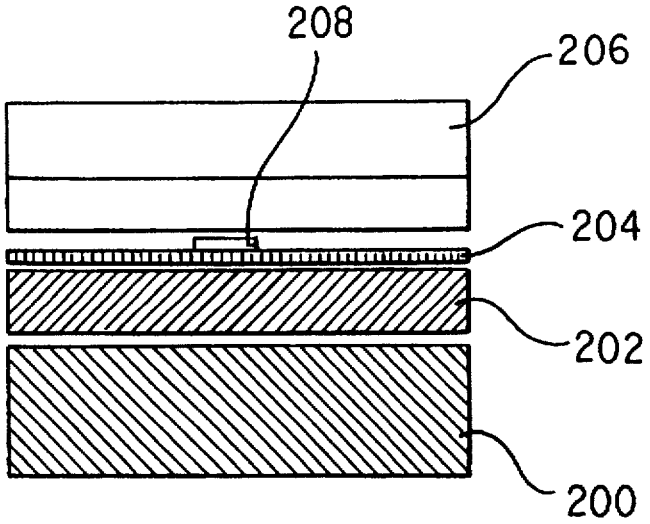
FIG. 3 is a sectional view showing an example of a microstrip feeding line.
Figure 4:
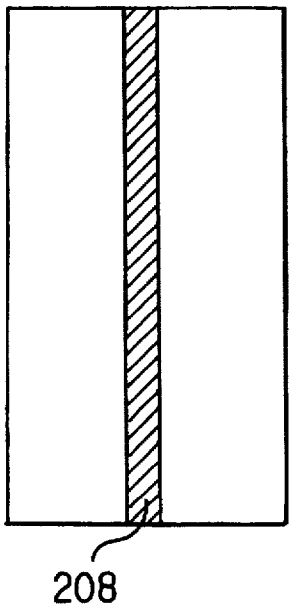
FIG. 4 is a top plan view showing a straight line microstrip.
Figure 5:
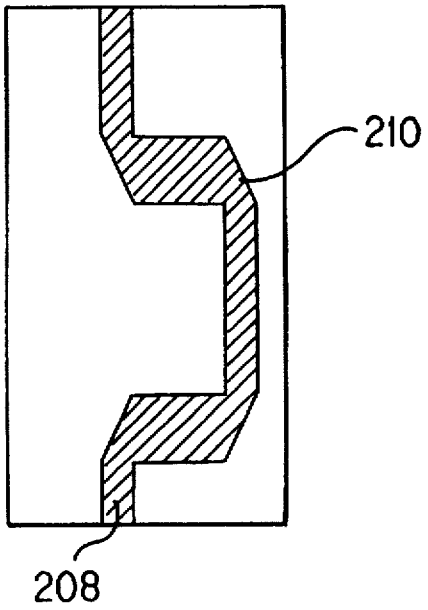
FIG. 5 is a top plan view showing a cranked line microstrip.
Figure 6:
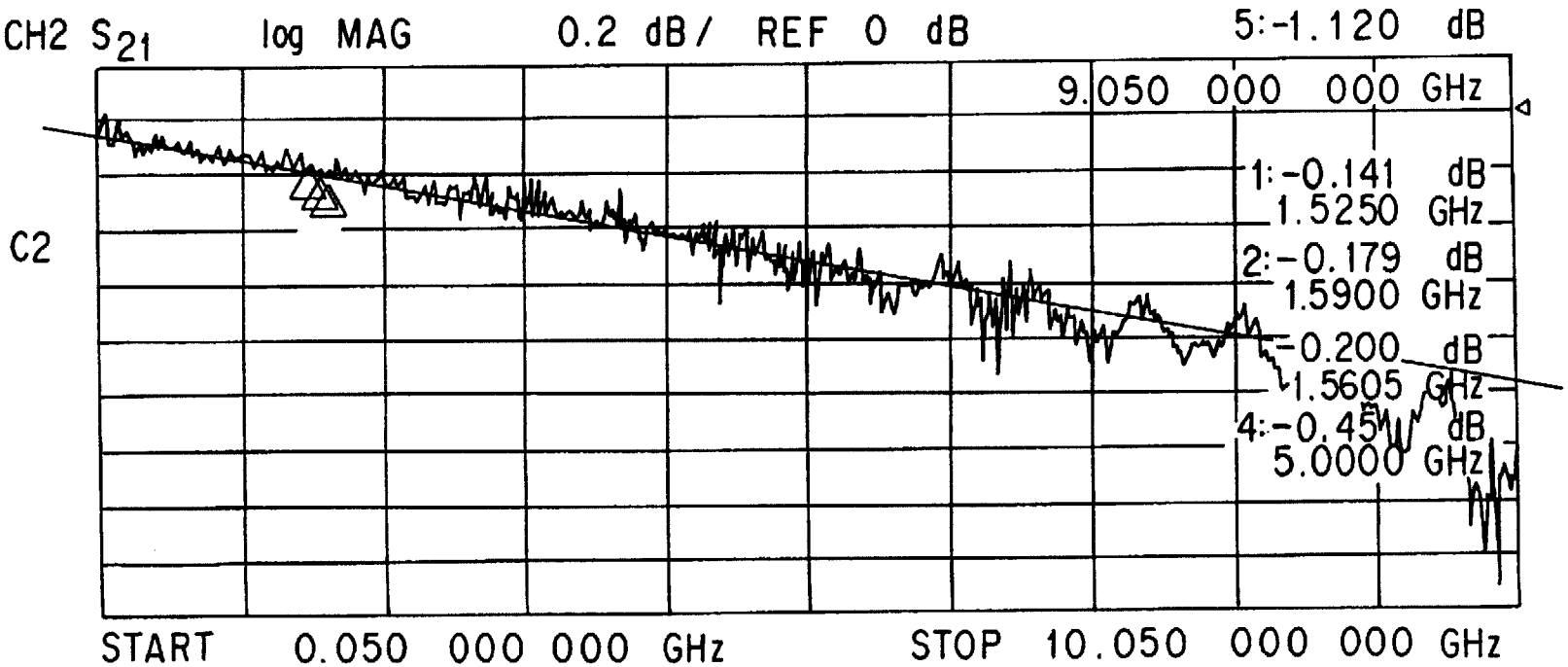
FIG. 6 is a graphical representation showing measurement results of the transmission loss of the FIG. 4 microstrip over the range from 0.05 GHz to 10.05 GHz.
Figure 7:
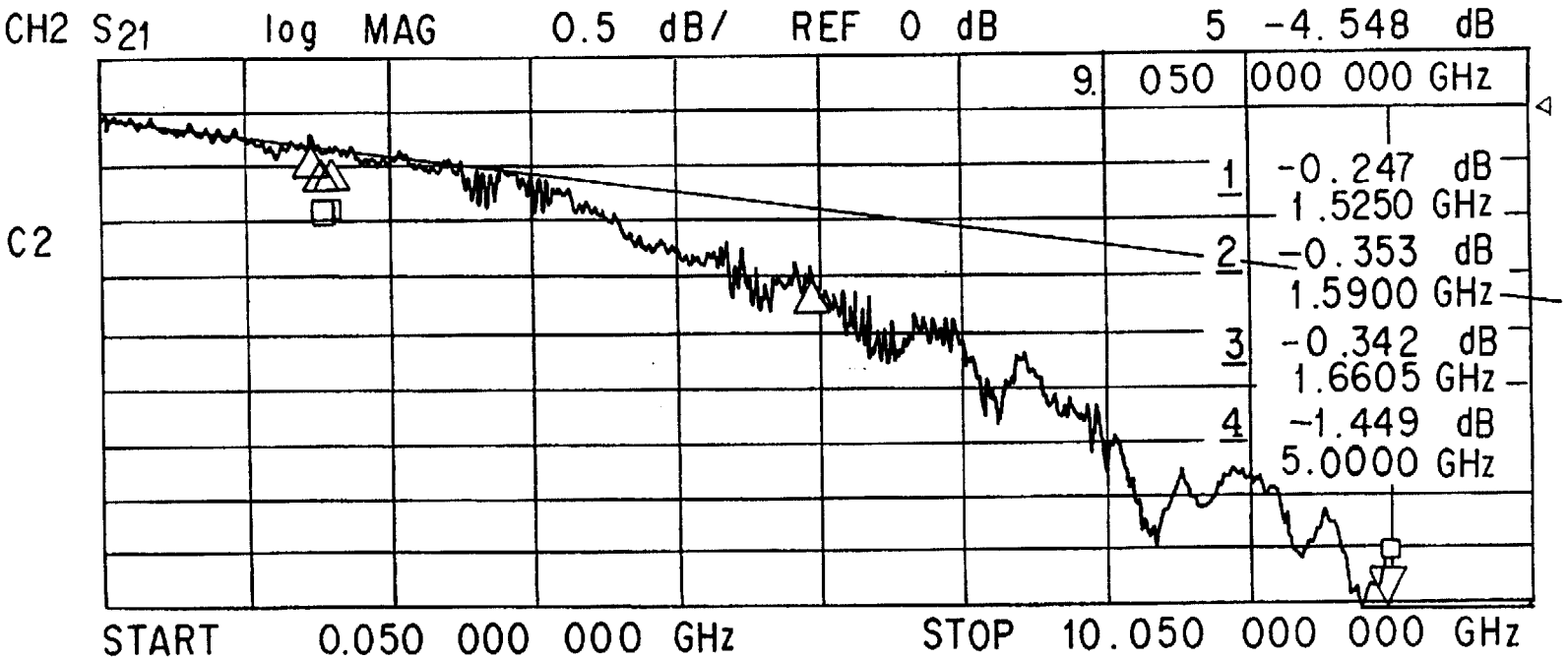
FIG. 7 is a graphical representation showing measurement results of the transmission loss of the FIG. 5 microstrip over the range from 0.05 GHz to 10.05 GHz.

This numerical value of 1% is backed up by the following fact. Now consider a configuration as shown in FIG. 3 comprising a substrate 200 on which a foamed dielectric layer 202, a dielectric film 204 and a foamed dielectric layer 206 are laminated in the mentioned order, the dielectric film 204 carrying a microstrip 208 thereon. Let the distance between the substrate 200 and the microstrip 208 be 1 mm which is equivalent to about 1% of the free-space wavelength of a 3 GHz electromagnetic wave. The transmission losses in cases where the microstrip 208 is shaped into a straight line (FIG. 4) and into a cranked line (FIG. 5) were measured, the results being graphically shown in FIG. 6 and 7, respectively. From the comparison of the straight line transmission loss depicted in FIG. 6 with the cranked line transmission loss depicted in FIG. 7 it can be seen that the latter transmission loss sharply increases in the vicinity of 3 GHz. The loss arising from the provision of a crank 210 as depicted in FIG. 5 is generally a radiation loss, and hence it can be envisaged in the configuration depicted in FIG. 3 that the crank 210 gives rise to little or substantially no radiation loss until at least about 3 GHz. In addition, the feeding line for use in an array antenna typically uses a number of cranks. From the above it can be seen that the radiation loss from the crank 210 is suppressed by setting the distance between the substrate 200 and the microstrip 208 and therefore the thickness of the foamed dielectric 202 to be 1% of the used frequency (1 mm at 3 GHz). It will be easily understood that the thickness of the dielectric 202 referred to hereat corresponds to the thickness of the dielectric layer 38 in the above embodiment.

Figure 8:
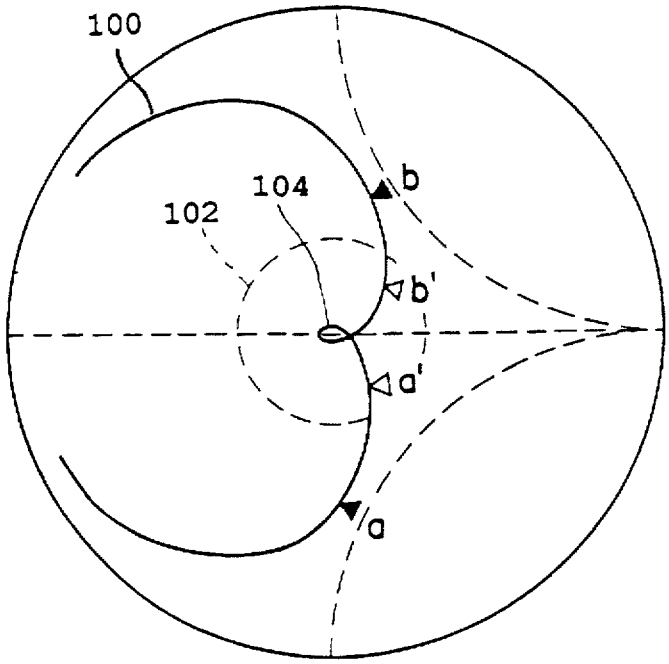
FIG. 8 is a Smith chart for explaining a procedure to design the input impedance characteristics of the antenna apparatus according to the present invention.
Figure 9:
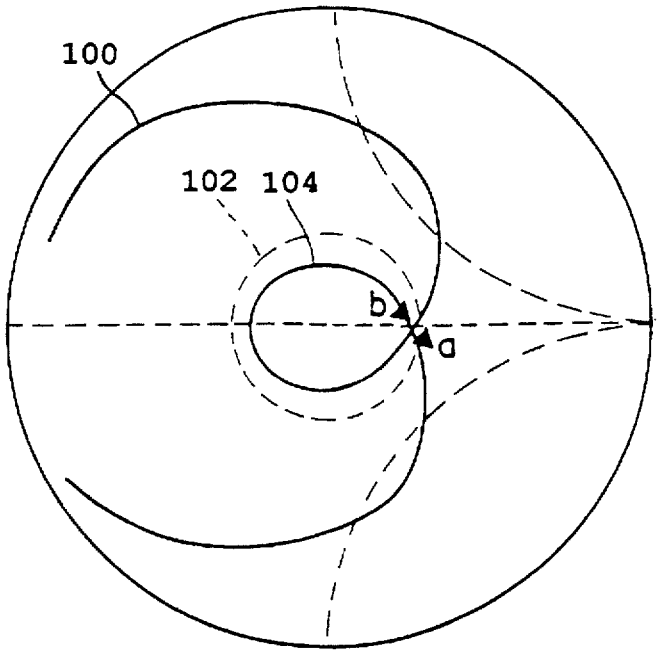
FIG. 9 is a Smith chart for explaining the procedure to design the input impedance characteristics of the antenna apparatus according to the present invention.
Figure 10:
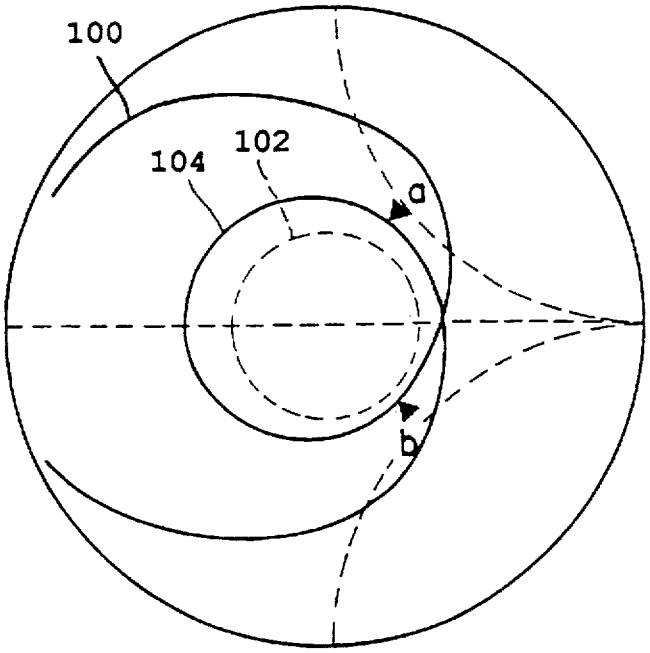
FIG. 10 is a Smith chart for explaining the procedure to design the input impedance characteristics of the antenna apparatus according to the present invention.

Referring now to FIGS. 8 to 10 there are depicted Smith charts representing variations in characteristics obtained when the intensity of the electromagnetic coupling of the radiation elements 46 and 50 is gradually heightened. In these diagrams a solid line 100 represents an input impedance of the apparatus shown in FIGS. 1 and 2 and a centrally described broken-line circle 102 represents a circle on which VSWR reflection coefficient or reflection loss is constant. Since the VSWR obtained inside of the broken-line circle 102 is less than the VSWR on the broken-line circle 102, it is envisaged that the input impedances are well matched in the region, lying within the broken-line circle 102, of the solid line representing characteristics.

In the configuration where the radiation element 46 fed directly through the feeding line 48 and the radiation element 50 not connected to the feeding line 48 are vertically arranged as shown in FIGS. 1 and 2, a part of the input impedance characteristic line 100 describes a loop 104 on the Smith chart as shown in FIGS. 8 to 10. The loop 104 can be positioned to the center of the Smith chart, that is, to the vicinity of the VSWR circle 102 indicated by the broken line circle, by adjusting the diameters of or the distances between the radiation elements 46 and 50 and between the elements and the conductive plate 36. It is particularlly preferable to appropriately adjust the size of the loop 104 and to allow the entirety of the loop 104 to lie inside of the VSWR circle 102 while rendering the loop 104 sufficiently large, whereby the input impedances can be matched over a relatively wide range of bands compared with the case of the small loop 104 as shown in FIG. 8 or the case of the loop 104 lying outside of the VSWR circle 102 as shown in FIG. 10. If the distance between the radiation elements 46, 50 and the flat conductive plate 36 is enlarged, then the band defined so far by markers a and b on FIG. 8 will be displaced to the region defined by markers a' and b', with the result that a relatively wide range of frequencies can be contained in the loop 104 with the size of the loop 104 unchanged, thereby enabling the impedances to be matched over a relatively wide frequency range. If the distance between the radiation element 46 and the radiation element 50 is reduced, then the loop 104 will be enlarged with the increase of the electromagnetic coupling between the two elements, again enabling the impedance to be matched over a relatively wide frequency range. It is to be noted that too small a distance between the radiation elements 46 and 50 would result in a VSWR value exceeding the desired VSWR value represented by the broken-line circle 102 in the diagram, failing to obtain any impedance matching. Thus in order to obtain the impedance matching over the widest frequency range, the distance between the radiation element 46 and the radiation element 50 is so designed that the size of the loop 104 becomes slightly smaller than that of the broken-line circle 102.

b) Embodiment 2

Figure 11:
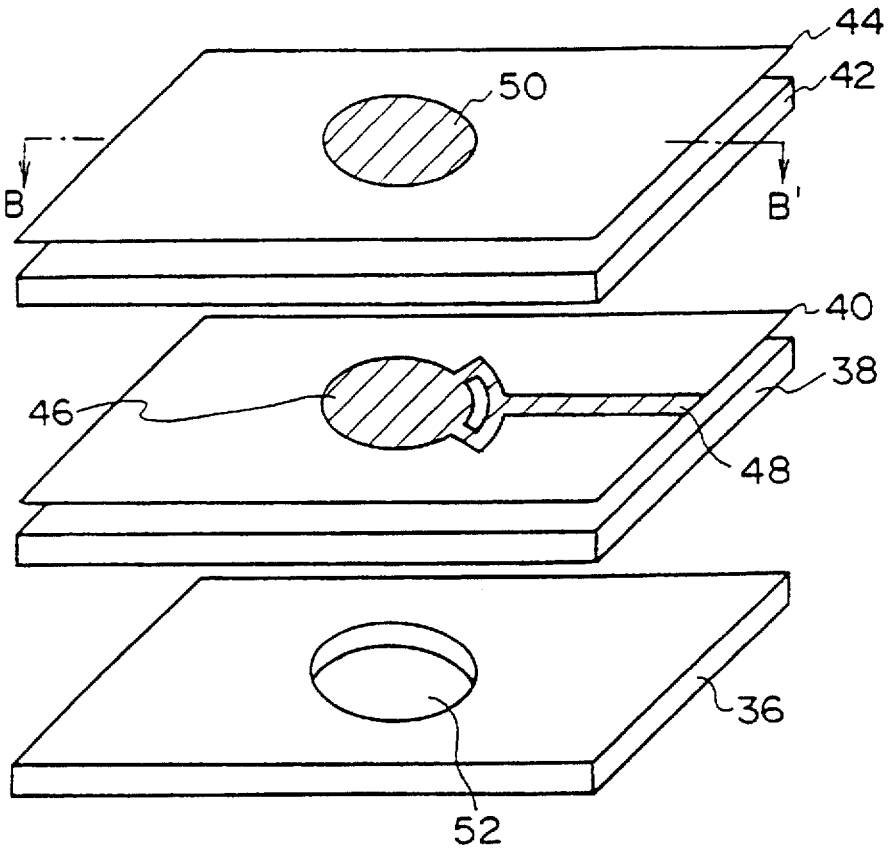
FIG. 11 is an exploded perspective view showing a configuration of an antenna apparatus according to second embodiment of the present invention.
Figure 12:
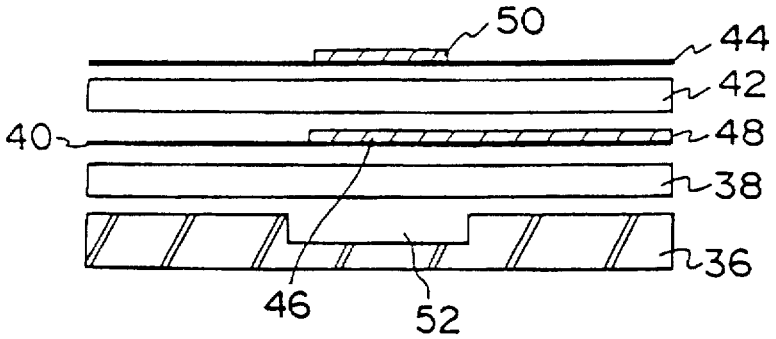
FIG. 12 is an end view, taken along the line B–B' of FIG. 11, of the antenna apparatus according to the second embodiment of the present invention.
Figure 13:
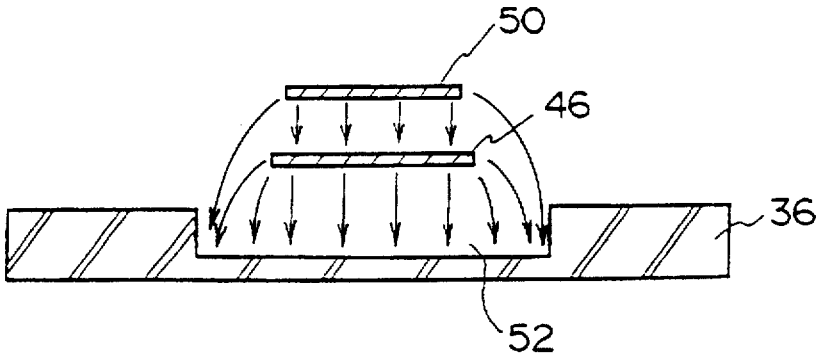
FIG. 13 is an end view showing a distribution of electric lines of force in the second embodiment, with the dielectric layers omitted.

Referring now to FIGS. 11 to 13 there is depicted a configuration of an antenna apparatus in accordance with a second embodiment of the present invention. This embodiment differs from the first embodiment in that a recess 52 is formed in the upper surface of the flat conductive plate 36. The recess 52 is positioned in such a manner that the center of the recess 52 is substantially coincident with the centers of the radiation elements 46 and 50. As shown in FIG. 13, preferably the size of the recess 52 is substantially equal to or larger than the sizes of the radiation elements 46 and 50 so that electric lines of force emitted from the edge portions of the radiation elements 46 and 50 can reach the interior of the recess 52. It is to be appreciated that the sizing of the recess 52 equal to the radiation elements 46 and 50 would necessitate a very precise working accuracy, resulting in a problem in the production process, and that too large a size of the recess 52 sufficient to reach the feeding line 48 would cause impedance discontinuities, making it difficult to match the impedances thereat. It is thus preferable that the recess 52 be so sized as not to interfere with the impedance matching and not to cause any problem in the production process.

The recess 52 is formed for the purpose of widening the frequency bands ensuring good impedance matching without increasing the thickness of the dielectric layer 38. Assume, for instance, that the first embodiment apparatus has presented the characteristics as shown in FIG. 8 with the dielectric layer 38 set to a certain thickness. Also assume that in terms of the characteristics shown in FIG. 8 the region defined by the markers a and b is a portion corresponding to the frequency band in which the input impedance matching must be secured in design requirements. It is necessary in this case that the frequency corresponding to the marker a be displaced to the point of the marker a', and the frequency corresponding to the marker b to the point of the marker b'. Possible alternatives in the first embodiment are firstly to increase the thickness of the dielectric layer 38 to enlarge the distance between the radiation elements 46, 50 and the flat conductive plate 36, and secondly to reduce the thickness of the dielectric layer 42 to decrease the distance between the radiation element 46 and the radiation element 50 to thereby enhance the strength of the electromagnetic coupling between the two elements.

However, several problems arise in the first method, that is, the method of increasing the thickness of the dielectric layer 38 to widen the impedance band. For instance, the distance between the radiation elements 46, 50 and the flat conductive plate 36 is not allowed to enlarge as far as the distance at which a high order mode propagation will occur among these elements. Furthermore in order to suppress the unnecessary radiation from the microstrip line constituted of the feeding line 48 and the flat conductive plate 36, it is not possible to enlarge, beyond a certain value, the distance between the feeding line 48 and the flat conductive line 36, and therefore the distance between the radiation elements 46, 50 and the flat conductive plate 36. The formation of recess 52 in the flat conductive plate 36, as in this embodiment, will make it possible to widen the distance between the radiation elements 46, 50 and the top surface of the flat conductive plate 36 without altering the distance between the feeding line 48 and the flat conductive plate 36. Thus this embodiment ensures the impedance matching over a relatively wide frequency band without increasing the unnecessary radiation from the microstrip line constituted of the feeding line 48 and the flat conductive plate 36.

Also, making the size of the recess 52 larger than the sizes of the radiation elements 46 and 50 will allow electric lines of force emitted from the end portions of the radiation elements 46 and 50 to be received within the interior of the recess 52 as shown in FIG. 13, thereby enabling the radiation elements 46 and 50 to operate in a normal mode irrespective of the formation of the recess 52.

c) Embodiment 3

Figure 14:
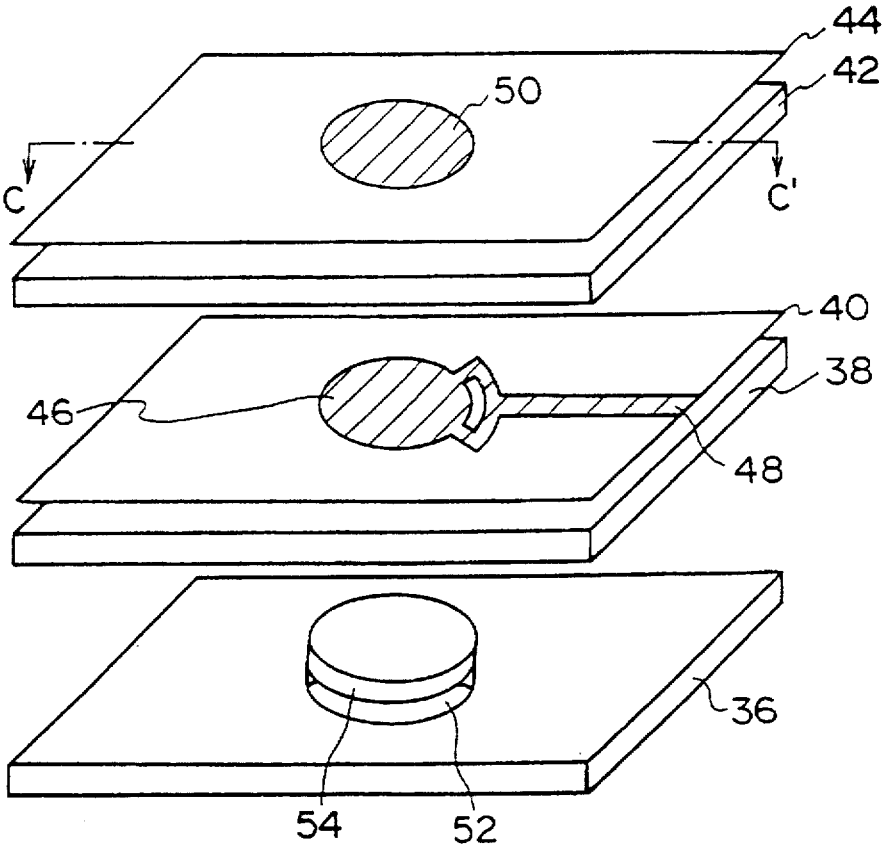
FIG. 14 is an exploded perspective view showing a configuration of an antenna apparatus according to third embodiment of the present invention.
Figure 15:
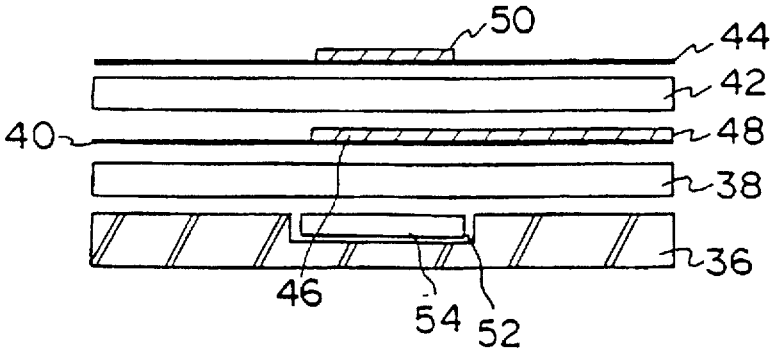
FIG. 15 is an end view, taken along the line C–C' of FIG. 14, of the antenna apparatus according to the third embodiment of the present invention.

Referring now to FIGS. 14 and 15 there is depicted a configuration of an antenna apparatus in accordance with third embodiment of the present invention. In this embodiment a dielectric piece 54 is accommodated within the interior of the recess 52 of the second embodiment. Use of such a dielectric piece 54 will provide an enhanced structural bearing strength in the region of the recess 52. Also use of a foamed dielectric to form the dielectric piece 54 will prevent or minimize the possibility of degrading electrical performance.

d) Embodiment 4

Figure 16:
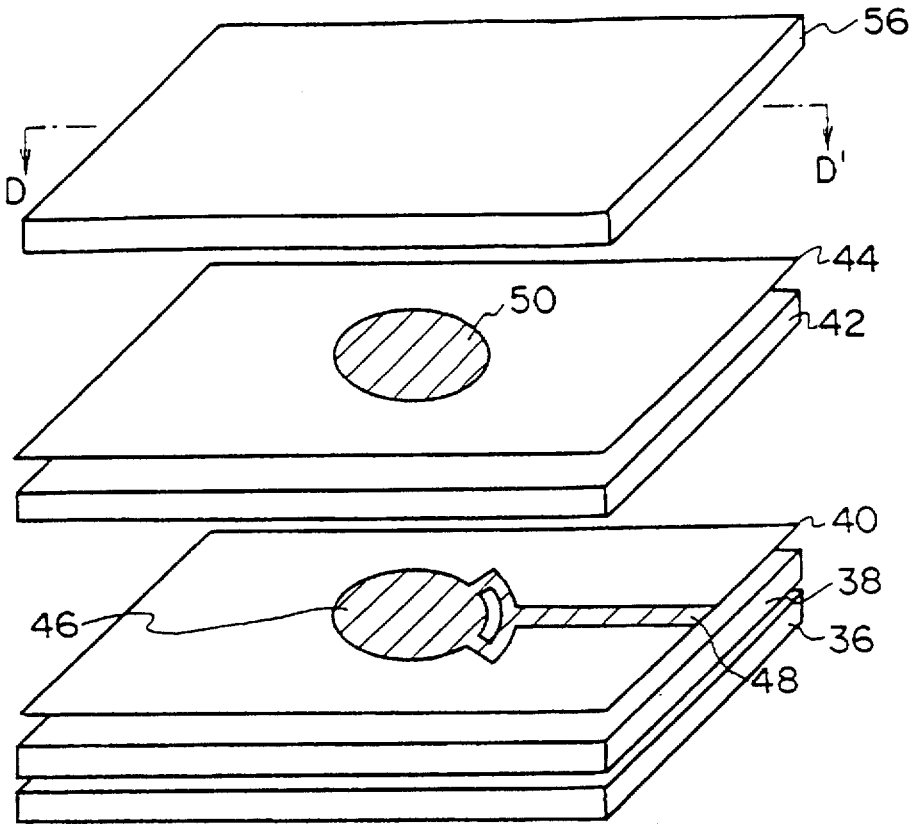
FIG. 16 is an exploded perspective view showing a configuration of an antenna apparatus according to fourth embodiment of the present invention.
Figure 17:
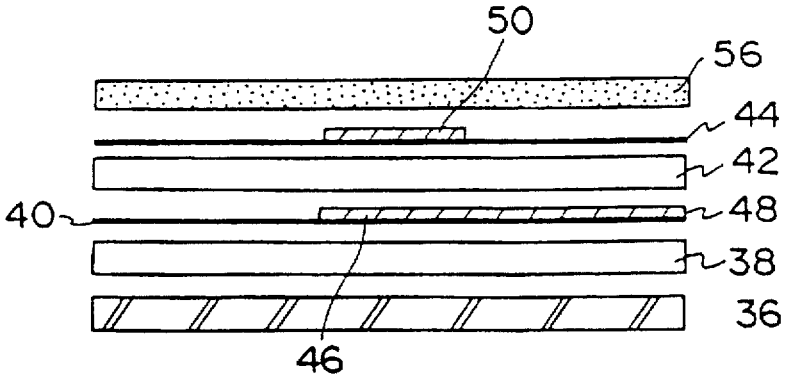
FIG. 17 is an end view, taken along the line D–D' of FIG. 16, of the antenna apparatus according to the fourth embodiment of the present invention.

Referring now to FIGS. 16 and 17 there is depicted a configuration of an antenna apparatus in accordance with fourth embodiment of the present invention. This embodiment further comprises a dielectric layer 56 in addition to the configuration of the first embodiment. The dielectric layer 56 is formed of a material having a higher dielectric constant than that of the dielectric material (foamed dielectric) constituting the dielectric layers 38 and 42. Accordingly electric lines of force emitted from the radiation element 46 are induced toward the radiation element 50. This will ensure an enhanced strength of the electromagnetic coupling between the radiation element 46 and the radiation element 50 compared with the first embodiment. Thus the strength of the electromagnetic coupling can be enhanced between the radiation element 46 and the radiation element 50 without reducing the thickness of the dielectric layer 42, realizing impedance matching over a wider frequency range.

It is to be appreciated that substantially the same effect can also be attained by interposing another layer, for instance, an air layer or a foamed dielectric layer, between the radiation element 50 and the dielectric layer 56. However, if such a layer is too thick, it may prevent the electric lines of force emitted from the end portions of the radiation element 46 from being induced toward the radiation element 50, which may result in a slightly reduced effect.

e) Embodiment 5

Figure 18:
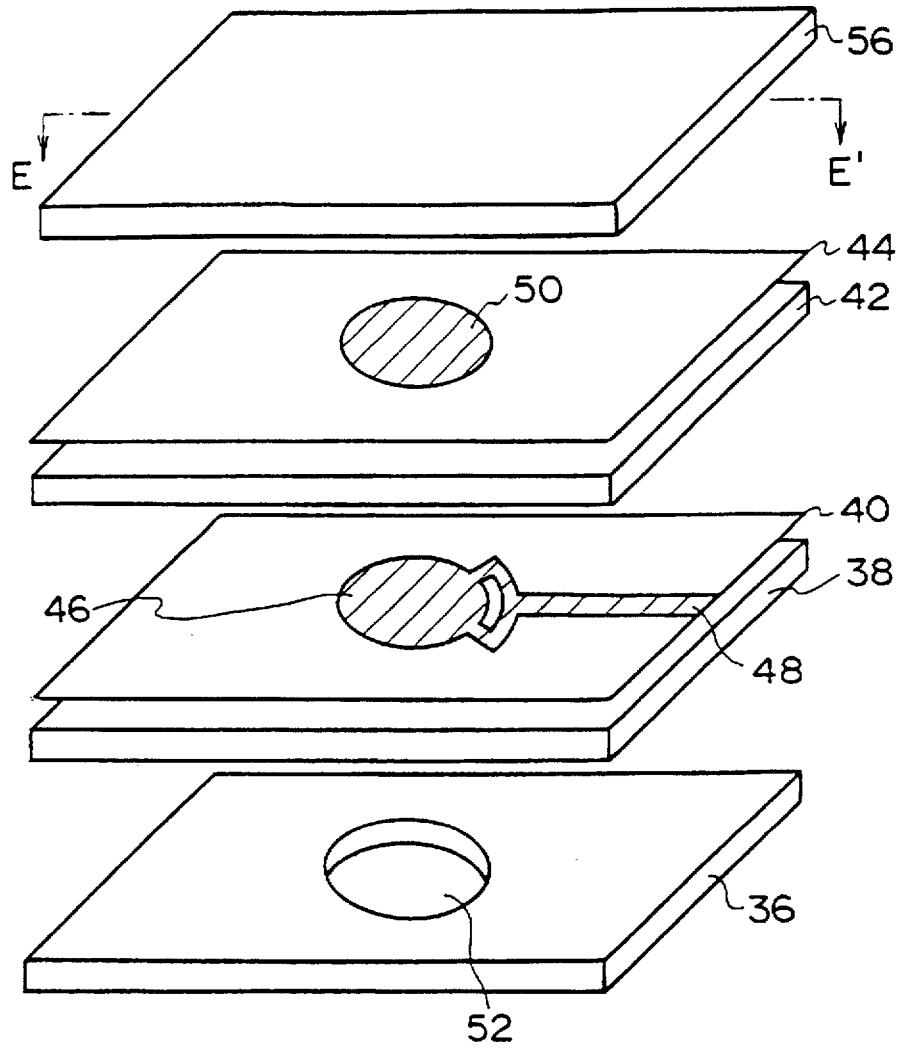
FIG. 18 is an exploded perspective view showing a configuration of an antenna apparatus according to fifth embodiment of the present invention.
Figure 19:
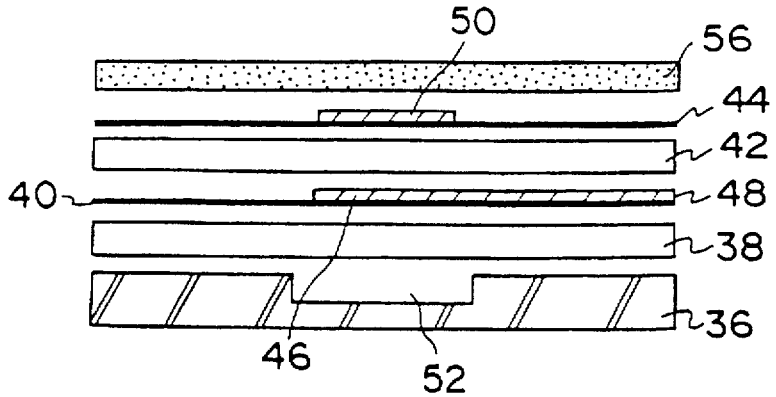
FIG. 19 is an end view, taken along the line E–E' of FIG. 18, of the antenna apparatus according to the fifth embodiment of the present invention.

Referring now to FIGS. 18 and 19 there is depicted an antenna apparatus in accordance with fifth embodiment of the present invention. This embodiment is a combination of the second embodiment and the fourth embodiment. As a result of this the effects of both the second and fourth embodiment can be attained. In addition the combination of the second embodiment and the fourth embodiment will allow the impedances to be matched over an even wider frequency range. It is natural that this embodiment may make use of the dielectric piece 54.

f) Embodiment 6

Figure 20:
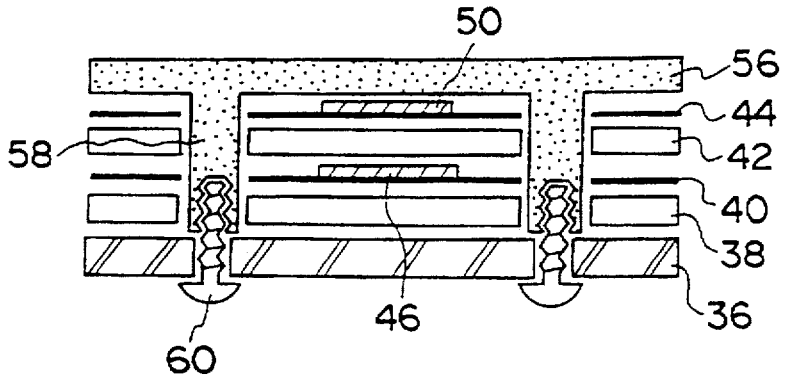
FIG. 20 is a sectional end view, taken along the line passing through a dielectric column but not passing through a feeding line, showing a configuration of an antenna apparatus according to sixth embodiment of the present invention.

Referring now to FIG. 20 there is depicted an antenna apparatus in accordance with a sixth embodiment of the present invention. In this embodiment a plurality of dielectric columns 58 extend downwardly from the dielectric layer 56 of the fourth embodiment. The plurality of dielectric columns 58 extend through the dielectric film 44, dielectric layer 42, dielectric film 40 and dielectric layer 38 into the flat conductive plate 36. The extremity of each dielectric column 58 is firmly secured to the flat conductive plate 36 by means of a screw 60.

This will ensure not only substantially the same effect as in the fourth embodiment but also a greater retaining strength compared with the fourth embodiment.

That is, since the dielectric films 40, 44 and the dielectric layers 38, 42 formed of foamed dielectric are typically flexible members, it would be difficult to steadfastly maintain the flatness or thickness thereof merely by layering them. The dielectric layer 56 is therefore superposed on the laminate as in the fourth embodiment, to improve the uniformity of the flatness or thickness. In order to further improve the uniformity of the flatness or thickness of dielectric layers 38, 42 and the dielectric films 40, 44, the dielectric layer 38 and the flat conductive plate 36 are fixedly joined together by means of the plurality of dielectric columns 58 and the screws 60 as in this embodiment. The dielectric column 58 may be provided in the vicinity of the center of the antenna apparatus to ensure a uniformity of the flatness or thickness in the central portion of the antenna apparatus. In addition, compared with the configuration having spacers provided along the peripheries of the antenna apparatus to fixedly join the dielectric layer 56 and the flat conductive layer 36, this embodiment requires a lower number of constituent parts due to the fact that the spacers are not used, resulting in lower production costs. Naturally this embodiment may be provided with the recess 52 or the dielectric piece 54.

g) Embodiment 7

Figure 21:
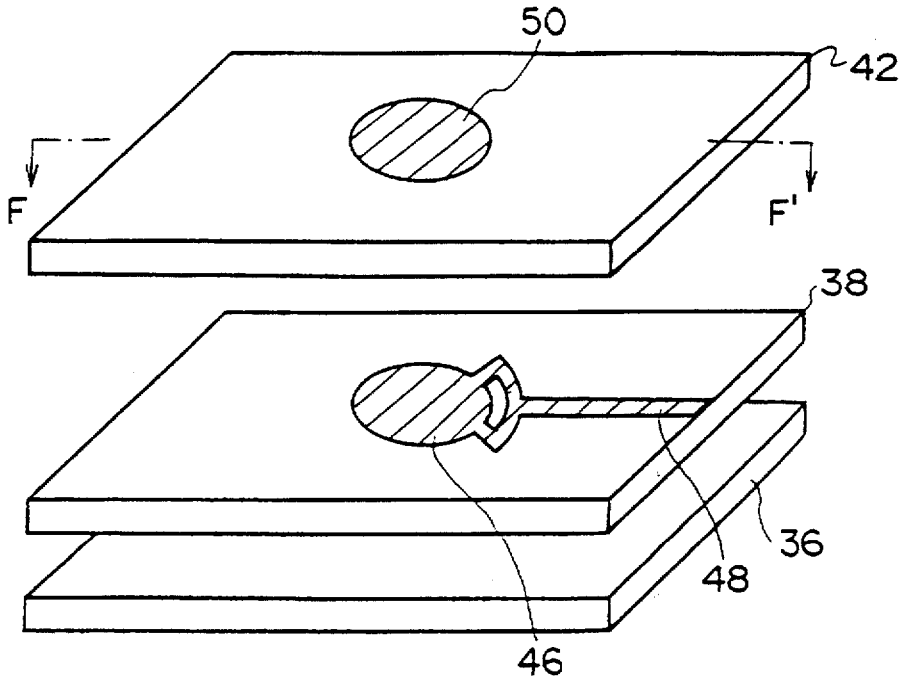
FIG. 21 is an exploded perspective view showing a configuration of an antenna apparatus according to seventh embodiment of the present invention.
Figure 22:
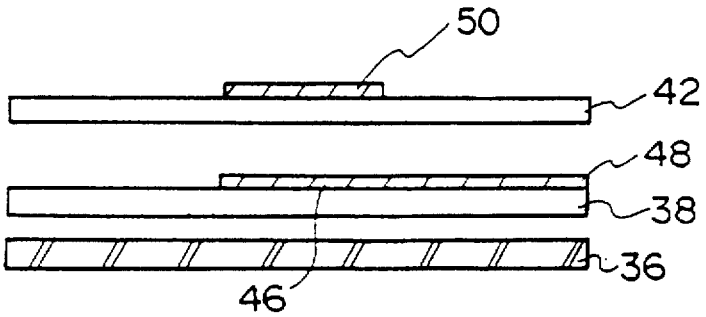
FIG. 22 is an end view, taken along the line F–F' of FIG. 21, of the antenna apparatus according to the seventh embodiment of the present invention.
Figure 23:
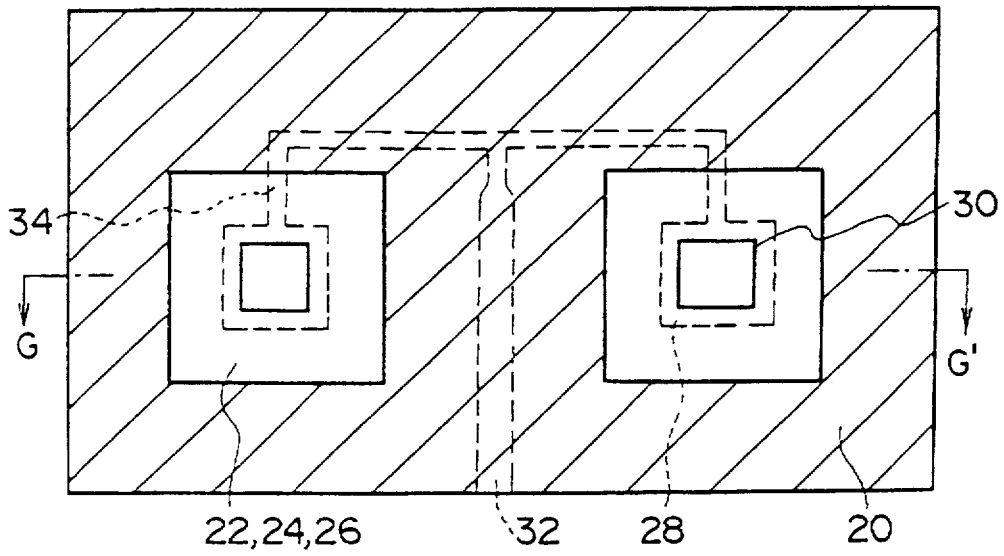
FIG. 23 PRIOR ART
FIG. 23 is a top view showing a configuration of a conventional antenna apparatus.
Figure 24:
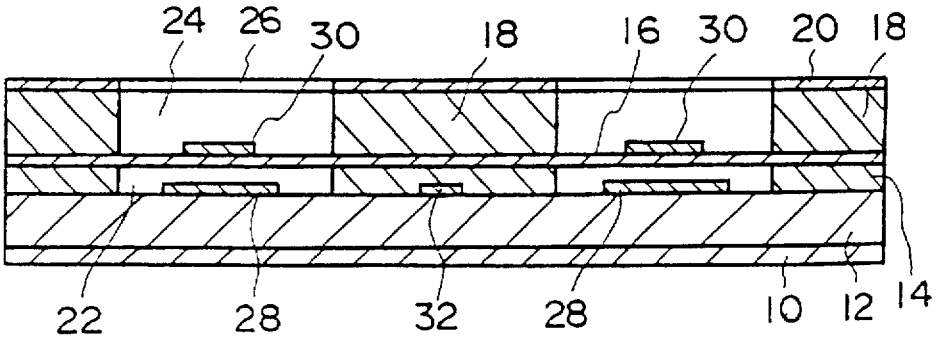
FIG. 24 is a sectional end view, taken along the line G–G' of FIG. 23, showing the configuration of the conventional antenna apparatus.

Referring finally to FIGS. 21 and 22 there is depicted a configuration of an antenna apparatus in accordance with seventh embodiment of the present invention. No use is made of the dielectric films 40 and 44 in this embodiment. The radiation element 46 and the feeding line 48 are disposed on top of the upper surface of the dielectric layer 38 and the radiation element 50 is disposed on top of the upper surface of the dielectric layer 42. Such a configuration will also ensure substantially the same effect as in the first embodiment. It is also possible to modify this embodiment on the basis of the second to sixth embodiments set forth hereinabove.

h) Supplement

Although in the above description the radiation elements 46 and 50 are of a circular shape, the present invention is not to be limited to the circular radiation elements. For the execution of the present invention, use may be made of the radiation elements 46 and 50 having another shape such, as a square. The present invention is not intended to be limited to the flat antenna but is applicable to an antenna having a curved surface portion. Although for the embodiments 4 to 6 description has only been given of the function of the dielectric layer 56 to enhance the strength of the electromagnetic coupling between the radiation element 46 and the radiation element 50, it is to be appreciated that the dielectric layer 56 functions also as a radome. In other words, the dielectric layer 56 has a function to protect the internal structure of the antenna apparatus, including the radiation elements 46 and 50, from the ambient environment, for instance, from rain, wind, temperature, humidity, dust, etc. Using the dielectric layer 56 also as the radome in this manner will contribute to the compactness of the apparatus configuration.

What is claimed is:

1. An antenna apparatus comprising:

a conductive layer having front and back surfaces;

a first dielectric layer having front and back surfaces and being arranged so that the back surface thereof confronts said front surface of said conductive layer, said first dielectric layer having a thickness less than the wavelength of a signal to be radiated by said antenna apparatus;

a second dielectric layer having front and back surfaces and being arranged so that the back surface thereof confronts the front surface of said first dielectric layer;

first and second radiation elements disposed on top of said front surface of said first and second dielectric layers, respectively, in such a manner that respective centers of said first and second radiation elements vertically coincide with each other by way of said second dielectric layer; and a feeding line disposed on top of said front surface of said first dielectric layer for use in feeding signals to be radiated to said first radiation element; wherein said conductive layer includes a recess positioned and formed in said front surface thereof in such a manner that said recess is superposed over said first radiation elements by way of said first dielectric layer when viewed from below in a vertical direction.

2. An antenna apparatus according to claim 1, wherein said recess is larger than said first radiation element, said recess being positioned and formed in such a manner that the entirety of said first radiation element is included within said recess when viewed from above in a vertical direction.

3. An antenna apparatus according to claim 1, further comprising:

a dielectric piece disposed within the interior of said recess.

4. An antenna apparatus according to claim 3, wherein said dielectric piece is formed of a foamed dielectric.

5. An antenna apparatus according to claim 1, further comprising;

a third dielectric layer disposed on top of said front surface of said second dielectric layer.

6. An antenna apparatus according to claim 5, wherein said third dielectric layer has a dielectric constant higher than that of said first and second dielectric layers.

7. An antenna apparatus according to claim 5, wherein said third dielectric layer is used as a radome for environmentally protecting at least said first and second radiation elements.

8. An antenna apparatus according to claim 5, further comprising:

a fixing member for firmly securing said third dielectric layer to said conductive layer.

9. An antenna apparatus according to claim 8, further comprising:

a columnar member formed integrally with said third dielectric layer and extending through said first and second dielectric layers into said conductive layer;

the extremity of said columnar member being firmly secured to said conductive layer by means of said fixing member.

10. An antenna apparatus according to claim 1, wherein said first dielectric layer has a thickness equal to or less than 1% of a wavelength to be radiated.

11. An antenna apparatus comprising:

a conductive layer having front and back surfaces;

a first dielectric layer having front and back surfaces and being arranged so that the back surface thereof confronts said front surface of said conductive layer, said first dielectric layer having a thickness less than the wavelength of a signal to be radiated by said antenna apparatus;

a second dielectric layer having front and back surfaces and being arranged so that the back surface thereof confronts the front surface of said first dielectric layer;

first and second radiation elements disposed on top of said front surface of said first and second dielectric layers, respectively, in such a manner that respective centers of said first and second radiation elements vertically coincide with each other by way of said second dielectric layer; and a feeding line disposed on top of said front surface of said first dielectric layer for use in feeding associated with said first radiation element; wherein said first dielectric layer has an overlaid structure consisting of first dielectric film and first dielectric substrate;

said first dielectric film having a surface on which said first radiation element and said feeding line are formed;

said first dielectric substrate having sufficient thickness to maintain the distance between said conductive layer and said first radiation element; and wherein said first dielectric substrate comprises a substrate formed of a foamed dielectric.

12. An antenna apparatus comprising:

a conductive layer having front and back surfaces;

a first dielectric layer having front and back surfaces and being arranged so that the back surface thereof confronts said front surface of said conductive layer, said first dielectric layer having a thickness less than the wavelength of a signal to be radiated by said antenna apparatus;

a second dielectric layer having front and back surfaces and being arranged so that the back surface thereof confronts the front surface of said first dielectric layer;

first and second radiation elements disposed on top of said front surface of said first and second dielectric layers, respectively, in such a manner that respective centers of said first and second radiation elements vertically coincide with each other by way of said second dielectric layer; and a feeding line disposed on top of said front surface of said first dielectric layer for use in feeding associated with said first radiation element; wherein said second dielectric layer has an overlaid structure consisting of a second dielectric film and a second dielectric substrate;

said second dielectric film having a surface on which said second radiation element is formed;

said second dielectric substrate having sufficient thickness to maintain the distance between said first radiation element and said second radiation element; and wherein said second dielectric substrate comprises a substrate formed of a foamed dielectric.

13. A method of manufacturing an antenna apparatus, comprising the steps of:

preparing a conductive plate, a first dielectric substrate having a uniform thickness less than a wavelength to be radiated, a first dielectric film having a thickness less than that of said first dielectric substrate, a second dielectric substrate having a uniform thickness, and a second dielectric film having a thickness less than that of said second dielectric substrate;

forming on the surface of said first dielectric film a first radiation element and a feeding line for feeding said first radiation element;

forming in a surface of said conductive plate a recess to be superposed over said first radiation element by way of said first dielectric film when viewed from below in a vertical direction;

forming a second radiation element on the surface of said second dielectric film; and after the execution of said steps, laminating on said conductive plate in the mentioned order said first dielectric plate, said first dielectric film, said second dielectric substrate, and said second dielectric film in such a manner that the distance between said conductive plate and said first radiation element is maintained by said first dielectric substrate and the distance between said first radiation element and said second radiation element is maintained by said second dielectric substrate and that respective centers of said first and second radiation elements vertically coincide with each other by way of said second dielectric substrate;

whereby manufactured is an antenna apparatus provided with said first radiation element to be power fed and with said second radiation element to be not power fed.

14. A method of designing an antenna apparatus, said antenna apparatus to be designed comprising:

a conductive layer having front and rear surfaces;

first dielectric layer having front and rear surfaces and being arranged so that the rear surface thereof confronts said front surface of said conductive layer, said first dielectric layer having a thickness less than the wavelength of a signal to be radiated;

second dielectric layer having front and rear surfaces and being arranged so that the rear surface thereof confronts said front surface of said first dielectric layer;

first and second radiation elements disposed on top of said front surfaces of said first and second dielectric layers, respectively, in such a manner that respective centers of said first and second radiation elements vertically coincide with each other by way of said second dielectric layer;

a feeding line disposed on top of said front surface of said first dielectric layer for use in feeding associated with said first radiation element; and a recess positioned and formed in said front surface of said conductive layer so that it is superposed over said first radiation element by way of said first dielectric layer when viewed from below in a vertical direction;

said method comprising the steps of:

determining the dimensions and/or intervals of said first and second radiation elements so that frequency characteristics of voltage standing wave ratio and/or reflection loss describe a loop on a Smith chart and that this loop surrounds the center of said Smith chart; and determining the thickness of said first dielectric layer and dimensions of said recess so as to ensure that the voltage standing wave ratio or the reflection loss in a frequency band to be radiated lies on said loop.

15. A method of designing an antenna apparatus, said antenna apparatus to be designed comprising:

a conductive layer having front and rear surfaces;

first dielectric layer having front and rear surfaces and being arranged so that the rear surface thereof confronts said front surface of said conductive layer, said first dielectric layer having a thickness less than the wavelength of a signal to be radiated;

second dielectric layer having front and rear surfaces and being arranged so that the rear surface thereof confronts said front surface of said first dielectric layer;

first and second radiation elements disposed on top of said front surfaces of said first and second dielectric layers, respectively, in such a manner that respective centers of said first and second radiation elements vertically coincide with each other by way of said second dielectric layer;

a feeding line disposed on top of said front surface of said first dielectric layer for use in feeding associated with said first radiation element;

a recess positioned and formed in said front surface of said conductive layer so that it is superposed over said first radiation element by way of said first dielectric layer when viewed from below in a vertical direction;

third dielectric layer disposed on top of said front surface of said second dielectric layer; and said method comprising the steps of:

determining the dimensions and/or intervals of said first and second radiation elements so that frequency characteristics of voltage standing wave ratio and/or reflection loss describe a loop on a Smith chart and that this loop surrounds the center of said Smith chart; and determining the dielectric constant of said third dielectric layer so as to ensure that the voltage standing wave ratio or the reflection loss in a frequency band to be radiated lies on said loop.

* * * * *